US011407577B1

(12) United States Patent
Watkins

(10) Patent No.: US 11,407,577 B1
(45) Date of Patent: Aug. 9, 2022

(54) MICROWAVE POPCORN BAG

(71) Applicant: Jeffrey T. Watkins, Princeton, MN (US)

(72) Inventor: Jeffrey T. Watkins, Princeton, MN (US)

( * ) Notice: Subject to any disclaimer, the term of this patent is extended or adjusted under 35 U.S.C. 154(b) by 0 days.

(21) Appl. No.: 17/544,059

(22) Filed: Dec. 7, 2021

(51) Int. Cl.
*B65D 81/34* (2006.01)
*B65D 65/46* (2006.01)

(52) U.S. Cl.
CPC ..... *B65D 81/3469* (2013.01); *B65D 65/466* (2013.01); *B65D 2581/3494* (2013.01)

(58) Field of Classification Search
CPC ..... B65D 81/3469; B65D 81/3461; B65D 2581/3487; B65D 2581/3494; B65D 2581/3497; B65D 81/34; B65D 75/008
See application file for complete search history.

(56) References Cited

U.S. PATENT DOCUMENTS

| | | | | |
|---|---|---|---|---|
| 3,066,844 | A | 12/1962 | Moore | |
| 4,015,085 | A | 3/1977 | Woods | |
| 4,036,423 | A | 7/1977 | Gordon | |
| 4,038,425 | A | 7/1977 | Brandberg | |
| 4,210,674 | A | 7/1980 | Mitchell | |
| 4,268,738 | A | 5/1981 | Flautt, Jr. | |
| 4,279,933 | A | 7/1981 | Austin | |
| 4,448,309 | A | 5/1984 | Roccaforte | |
| 4,553,010 | A | 11/1985 | Bohrer | |
| 4,641,005 | A | 3/1987 | Seiferth | |
| 4,678,882 | A | 7/1987 | Bohrer | |
| 4,734,288 | A | 3/1988 | Engstrom | |
| 4,825,025 | A | 4/1989 | Seiferth | |
| 4,861,958 | A | 8/1989 | Bohrer | |
| 5,008,024 | A | 4/1991 | Watkins | |
| 5,097,107 | A | 3/1992 | Watkins | |
| 5,214,257 | A | 5/1993 | Riskey | |
| 5,334,820 | A | 8/1994 | Risch | |
| 5,871,790 | A | 2/1999 | Monier | |
| 6,320,172 | B1 | 11/2001 | Watkins | |
| 6,586,715 | B2 | 7/2003 | Watkins | |
| 7,022,955 | B2 | 4/2006 | Watkins | |
| 10,589,918 | B2 * | 3/2020 | DeVerney | B65D 81/3453 |

(Continued)

FOREIGN PATENT DOCUMENTS

| | | | |
|---|---|---|---|
| EP | 0320294 | A2 | 6/1989 |
| EP | 0205304 | B1 | 3/1991 |

(Continued)

*Primary Examiner* — Anthony D Stashick
*Assistant Examiner* — Raven Collins
(74) *Attorney, Agent, or Firm* — Neustel Law Offices

(57) ABSTRACT

A microwave popcorn bag for containing and heating popcorn kernels in a microwave oven. The bag is constructed of a laminated fibrous material and comprises a base panel, top panel, side panels, and interior space. The side panels have gussets with fold areas and fold lines that are adjacent to the base panel and that enable the bag to expand. An oil-resistant microwave susceptor film is laminated with the fibrous material and extends laterally across the base panel and the fold lines into the fold areas. Microwave interactive material is confined to the base panel. As the popcorn is heated, the bag expands and the microwave susceptor film forms a tray structure that collects oil and resists it penetrating through the fibrous material.

23 Claims, 12 Drawing Sheets

(56) References Cited

U.S. PATENT DOCUMENTS

| | | | | |
|---|---|---|---|---|
| 2009/0061053 | A1* | 3/2009 | Gaylor | B65D 81/3453<br>426/243 |
| 2020/0115139 | A1* | 4/2020 | Birchmeier | B65B 5/067 |
| 2021/0086976 | A1* | 3/2021 | France | B65D 81/3469 |
| 2021/0387788 | A1* | 12/2021 | Gorman | B65D 81/3469 |

FOREIGN PATENT DOCUMENTS

| | | | |
|---|---|---|---|
| EP | 0451530 | A2 | 10/1991 |
| EP | 0317203 | B1 | 2/1993 |
| FR | 1399151 | A | 4/1965 |
| GB | 841015 | A | 7/1960 |
| GB | 2046060 | A | 11/1980 |
| WO | 9115096 | A1 | 10/1991 |
| WO | 9636546 | A1 | 11/1996 |

* cited by examiner

MICROWAVE POPCORN BAG

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to a construct and microwave susceptor for heating a food item in a microwave oven, and more particularly a popcorn bag and microwave susceptor for popping popcorn in a microwave oven.

A construct for heating a food item in a microwave oven, such as a microwave popcorn bag, can be constructed of a fibrous material such as a paper product. The construct generally includes a microwave susceptor for converting microwave energy generated by a microwave source, e.g., the oven, to thermal energy. The thermal energy in turn heats a food item contained in the construct, such as kernels of popcorn in a bag, in order to cook the food item or, in the case of popcorn kernels, to cause them to pop. The construct may also contain a flavored or non-flavored cooking oil-producing substance which liquifies as it is heated with the food item. In the case of popcorn kernels, the heated liquified cooking oil helps cause the kernels to pop and helps the popped corn stay moist and resist burning. Other food items also may produce oil-containing and/or other juices as it cooks.

After manufacture, a microwave popcorn bag or other microwave food construct can spend a considerable amount of time in transit and/or in storage prior to being used. As a result, oil and/or grease from the popcorn or other food item, and/or from an oil-producing substance, in the bag or other construct can spend a considerable amount of time in contact with the fibrous material of the bag or other construct. With such extended contact, there is a substantial risk of the oil and/or grease penetrating into and even through the fibrous material. In addition, while the bag or other construct is in use and as the popcorn or other food item in the bag or other construct is heated, liquified cooking oil and/or oil-containing juices can penetrate into and through the fibrous material. Penetration of oil, grease, and/or other juices into the fibrous material can stain the bag or other construct, which is unattractive to consumers. In addition, leakage through the fibrous material can result in a mess inside and outside of the bag or other construct, including inside a microwave.

To prevent penetration and leakage, the fibrous material may be sprayed or otherwise treated with certain chemical substances that resist penetration of the oil and/or other juices into and through the fibrous material. For example, the fibrous material can be treated with certain fluorocarbon (FC)-containing substances which penetrate and permeate the fibrous material. When applied to fibrous materials, such FC-containing substances are generally effective at repelling oil and oil-containing liquids. However, some FC-containing substances may include PFAS (per-and polyfluoroalkyl substances) and for various reasons some retail and wholesale customers desire not to use fibrous packaging containing PFAS. In addition, some manufacturers of some of the FC-containing substances are discontinuing the use of FC-based grease proof coatings and chemistries.

Accordingly, there is a need to address the problem of oil, grease, and/or other oil-containing juices penetrating into and through microwave food constructs in general, and more specifically microwave popcorn bags, that are made of fibrous materials such as paper products, but without using FC-containing chemical substances that may include PFAS. As described and claimed below, the present invention provides a unique microwave food construct and microwave susceptor, specifically a microwave popcorn bag and microwave susceptor, that addresses this need as well as others.

SUMMARY

The various example embodiments of the present disclosure relate to a construct and a microwave susceptor film for heating a microwave food item, in particular microwave popcorn. The construct is comprised of a fibrous material and includes the microwave susceptor film for heating kernels of the popcorn in a microwave oven. The microwave susceptor film also effectively resists the penetration of oil, grease, and/or other juices through the fibrous material without the need to treat the fibrous material with potentially undesired chemical substances.

According to an example embodiment, the construct includes an interior space with an interior volume, a first panel (e.g., base panel) with a surface for supporting the popcorn kernels in the interior space, and a second panel (e.g., first side panel) that is adjacent to the first panel for containing the popcorn kernels in the interior space. The microwave susceptor film extends across the first panel and into the second panel to resist oil penetrating through the fibrous material of the construct.

According to one aspect of the example embodiment, the second panel has an expandable portion with a fold area near the base panel, and the microwave susceptor film extends into the fold area. According to another aspect, the fibrous material comprises a laminate having an inner layer and an outer layer, and the microwave susceptor film is present between the inner layer and the outer layer. According to another aspect, the oil-resistant material of the microwave susceptor film comprises a biodegradable cellulose material. According to yet another aspect, the microwave susceptor film has a microwave interactive material that is present only in the first panel.

According to yet another aspect of the example embodiment, the construct includes a third panel (e.g., second side panel) that is adjacent to the first panel for containing the popcorn kernels and that is substantially opposite the second panel, and the microwave susceptor film extends across the first panel into the second and third panels. According to yet another aspect, the third panel has an expandable portion with a fold area near the base panel, and the microwave susceptor film extends into the fold area.

According to yet another aspect of the example embodiment, the construct has a first end portion and a second end portion that is substantially opposite the first end portion, the second panel extends substantially the entire distance between the first end portion and the second end portion, and the microwave susceptor film extends along the second panel substantially the entire distance between the first end portion and the second end portion. According to yet another aspect, the third panel extends substantially the entire distance between the first end portion and the second end portion, and the microwave susceptor film extends along the third panel substantially the entire distance between the first end portion and the second end portion. According to yet another aspect, when the expandable portion of each of the second panel and the third panel is expanded, the microwave susceptor film forms a tray structure with a bottom on the first panel and opposed sides along the second panel and the third panel.

According to another example embodiment, the construct has a base panel with a surface for supporting popcorn kernels to be heated, a top panel substantially opposite to the base panel, a first side panel between the base panel and the top panel for containing the popcorn kernels, and a second side panel between the base panel and the top panel for containing the popcorn kernels that is substantially opposite to the first side panel. The first side panel comprises a first gusset with a first fold area and the second side panel comprises a second gusset with a second fold area. The first gusset is expandable in the first fold area and the second gusset is expandable in the second fold area. The microwave susceptor film comprises an oil-resistant film with a microwave interactive material, and the oil-resistant film extends across the base panel into the first fold area and the second fold area to resist oil penetrating through the fibrous material. The microwave interactive material is present only in the base panel.

According to an aspect of the example embodiment, the microwave interactive material has a first side substantially facing the first side panel and a second side substantially facing the second side panel, the first side is tapered toward the base panel until no microwave interactive material is present at the first side panel, and the second side is tapered toward the base panel until no microwave interactive material is present at the second side panel. According to another aspect, the oil-resistant film extends into the first side panel substantially the entire distance between the base panel and the top panel. According to another aspect, the oil-resistant film extends into the second side panel substantially the entire distance between the base panel and the top panel. According to yet another aspect, the first side panel extends along the base panel substantially the entire distance between a first end portion and a second end portion of the construct, and the oil-resistant film extends along the first side panel substantially the entire distance between the first end portion and the second end portion. According to yet another aspect, the second side panel also extends along the base panel substantially the entire distance between the first end portion and the second end portion, and the oil-resistant film extends along the second side panel substantially the entire distance between the first end portion and the second end portion.

According to another example embodiment, a microwave susceptor film is configured for use in a construct for heating a microwave food item. The construct is comprised of a fibrous material and has a first panel for supporting the food item and second and third panels adjacent to the first panel for containing the food item. The microwave susceptor film has an oil-resistant film and a microwave interactive material on the oil-resistant film, and is configured so that the oil-resistant film is able to extend across the first panel into the second and third panels to resist oil penetrating the fibrous material, and the microwave interactive material is confined entirely to the first panel.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

Figure 1:
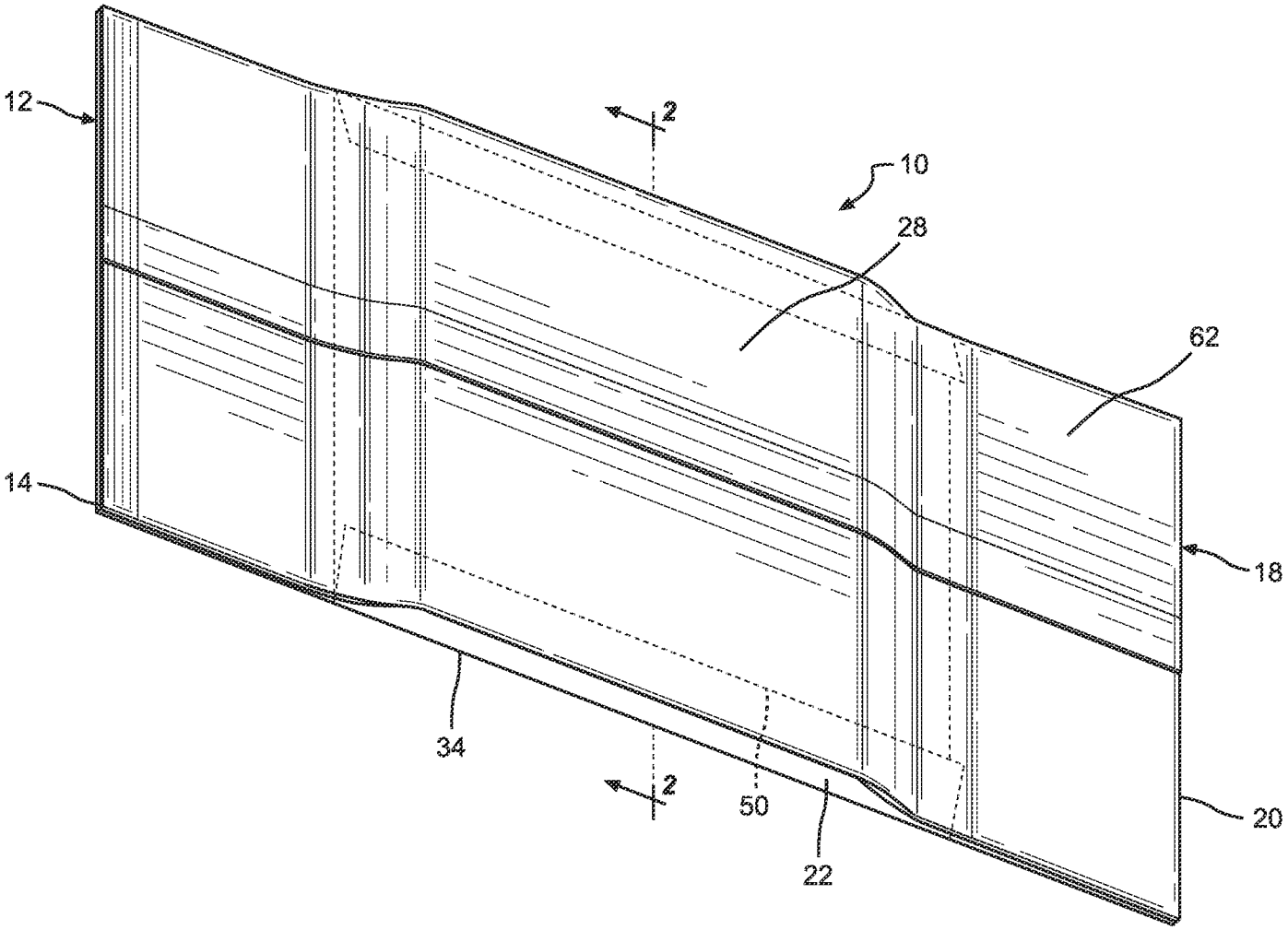
FIG. 1 is a perspective view of a microwave food construct comprising a microwave popcorn bag and microwave susceptor in accordance with an example embodiment with the bag unexpanded.

A. Overview.

As shown in FIGS. 1-7 among others, an example embodiment disclosed herein relates to a microwave food construct 10 comprising a microwave bag and microwave susceptor for containing and heating popcorn kernels and an optional cooking oil-producing substance in a microwave oven. The construct 10, which is also sometimes referred to herein as a bag or shell, is constructed of laminated fibrous material having an outer layer 62 and an inner layer 64. The construct 10 has a top panel 28, an opposing base panel 34, and opposing first and second side panels 22 between the top panel 28 and the base panel 34. The base panel 34 supports popcorn kernels 44 (or another microwave food item, e.g., pork rinds or puff pellets) and optionally a substance for producing cooking oil 46. The opposing first and second side panels 22 have first and second folding portions or areas 24 and first and second fold lines 26 respectively that are adjacent to the base panel 34. The top panel 28, base panel 34, and opposing side panels 22 are arranged to define an interior space 38 with an interior volume.

The microwave susceptor film 50 comprises an oil-resistant film, a portion of which comprises a microwave interactive material 52. The film 50 is laminated between the outer layer 62 and the inner layer 64 of the fibrous material. The portion comprising the microwave interactive material 52 is contained entirely in the base panel 34 while the oil-resistant film extends laterally across the base panel 34, across the first and second fold lines 26 that are adjacent to the base panel 34, and into the respective first and second fold areas 24 of the first and second side panels 22. Depending on the embodiment, the oil-resistant film may extend across some or all of the fold areas 24 and fold lines 26 comprising the opposing first and second side panels 22 and substantially all the way to the top panel 28 to resist penetration of oil and/or grease through the fibrous material.

As constructed, and prior to use, the construct 10 has a relatively flat profile with the top panel 28 and base panel 34 being spaced relatively close together and the first and second fold areas 24 of the side panels 22 being folded in on themselves along the fold lines 26. In this state, the volume of the interior space 38 is relatively small but is sufficient to contain the popcorn kernels 44 and the optional oil-producing substance 46 (or another microwave food item) to be heated. Such items are introduced into a lower portion of the interior space 38 of the construct 10 adjacent to and in contact with the base panel 34 and potentially the first and second fold areas 24 of the respective first and second side panels 22 during the manufacturing process.

In use, the construct 10 is placed on a platform in a microwave oven with the base panel 34 and microwave susceptor in contact with and supported on the platform. The popcorn kernels 44 and optional oil-producing substance 46 (or other microwave food item) to be heated are in contact with and are supported on portions of the interior surface 40 of the inner layer 64 of the construct 10 that correspond to the base panel 34 and the microwave susceptor film 50. They may also be in contact with portions of the interior surface 40 that correspond to either or both of the first and/or second side panels 22 that are adjacent to the base panel 34, e.g., first and second fold areas 24 and first and second fold lines 26. As the microwave susceptor applies heat to the popcorn kernels 44 and the optional oil-producing substance 46, the kernels begin to pop, releasing gases and filling the interior space 38. This causes the construct 10, including the side panels 22, to expand outwardly and the fold areas 24 to unfold along the fold lines 26.

As the fold areas 24 unfold along the fold lines 26, the oil-resistant microwave susceptor film 50 forms an elongated substantially U-shaped tray structure. The bottom of the tray lies on the base panel 34 and extends between the opposed first and second side panels 22. The bottom of the tray comprises the oil-resistant film and the microwave interactive material 52. The opposed sides or legs of the tray comprise only the oil-resistant film and extend across the first and second fold lines 26 that are adjacent to the base panel 34 and upwardly into and along the first and second fold areas 24 of the respective first and second side panels 22 that are adjacent to the base panel 34. Any oil, grease or other juices that may result from the heating process enter and are collected in the tray structure. The microwave susceptor film 50 thus helps prevent the oil, grease, or other juices from coming in contact with and potentially penetrating through the fibrous material of the construct 10 in the fold areas 24 and along the fold lines 26, which are the areas that are most susceptible to such penetration and leakage.

B. Microwave Food Construct.

With reference primarily to FIGS. 1-9, an example microwave food construct 10 can be in the form of a bag for containing and heating microwave popcorn or another microwave food item, e.g., pork rinds or puff pellets. Alternatively, the construct 10 can be in the form of another type of shell, e.g., carton, box, etc. for the same or a different type of microwave food item. The construct 10 is preferably constructed of a fibrous material such as a paper-based product. For example, the fibrous material can comprise a single thin layer of a paper-based product or more preferably and as described further herein a laminate of multiple layers of paper-based product, for example an outer layer 62 and an inner layer 64. In the present example embodiment, the fibrous material is preferably relatively thin and flexible to allow the construct 10 to be expandable as also described further herein. However, in other embodiments the fibrous material may be somewhat thicker and stiffer. For example, in some embodiments the fibrous material may comprise paperboard or cardboard. Although not preferred for use in the present example embodiment, such variations are contemplated for use with various food items and are thus intended to be encompassed within the scope of the present disclosure.

The example microwave food construct 10 is configured to contain a microwave food item 44 such as popcorn kernels (or another microwave food item, e.g., pork rinds, puff pellets, etc.) and optionally a cooking oil-producing substance 46 for heating in a microwave oven. While the optional cooking oil- producing substance 46 is helpful to include with certain food items 44 like popcorn kernels to help cause the kernels to pop and the popped kernels to stay moist and resist burning, the substance 46 may or may not be needed or helpful with other types of food items 44. Some food items 44 also may themselves produce oil, oil-containing liquids, and/or other juices as they are heated. If used, the cooking oil-producing substance 46 can comprise a semi-solid cooking grease or fat that can be melted or liquified upon application of heat to produce a liquid cooking oil substance. The substance 46 can also include flavoring components such as butter, salt, etc.

The example microwave food construct 10 in the form of a microwave popcorn bag is preferably constructed of a single piece of fibrous material or more preferably of a single piece of a multi-layer laminate of fibrous material in a manner further described herein. As shown in FIGS. 1-4 for example, the construct 10 has a first end portion 12, a second end portion 18, a top panel 28, a base panel 34, and first and second side panels 22. The first end portion 12 and the second end portion 18 are arranged to be substantially opposed to each other. The top panel 28 and the base panel 34 also are arranged to be substantially opposed to each other. A portion of the top panel 28 at or near the first end portion 12 and a portion of the base panel 34 at or near the first end portion 12 are configured and adapted to be adhered together and form a first end portion seal 14. Similarly, portion of the top panel 28 at or near the second end portion 18 and a portion of the base panel 34 at or near the second end portion 18 are configured and adapted to be adhered together and form a second end portion seal 20.

The first and second side panels 22 are arranged to be substantially opposed to each other. Each of the first and second side panels 22 extends substantially completely between and joins together the top panel 28 and the base panel 34, preferably at or near opposite outer edges of the top panel 28 and base panel 34 respectively. Each of the first and second side portions 22 also extends substantially completely along the opposite outer edges of the top panel 28 and the base panel 34 between the first end portion 12 and the second end portion 18 including the first end portion seal 14 and the second end portion seal 20.

The top panel 28, the base panel 34, the first and second side portions 22, and the first and second end portion seals 14, 20 are arranged so that the construct 10 defines an interior space 38 that has an interior volume. The construct 10 also has an interior surface 40 and an exterior surface 42 that is opposite of the interior surface 40. The interior space 38 is configured and adapted to contain the food item 44, e.g., popcorn, after the construct 10 is manufactured, during transit and storage, and while and after the food item is heated. The interior space 38 is also configured and adapted to contain the optional oil-producing substance 46 and/or other oils or juices that may be produced when the food item 44 is heated.

In the example embodiment, the interior surface 40 of the construct 10 is comprised of an interior surface of the inner layer 64 of the laminated fibrous material of which the construct 10 is made. The interior surface 40 is exposed to and may come in contact with the food item 44, optional oil-producing substance 46, and various other oils, grease, juices, etc. in various locations during transit, storage, and use of the construct 10. More specifically, and as will become apparent from the description herein, the interior surface 40 is particularly likely to come in contact with the food item 44, optional oil-producing substance 46, and/or various other oil-containing liquids, juices, etc. in areas that correspond to the base panel 34 and at least parts of the first and second side panels 22 that are adjacent to the base panel 34. These areas are thus particularly at risk for penetration by the oil and/or various other liquids into and through the laminated fibrous material.

Also in the example embodiment, the exterior surface 42 of the construct 10 is comprised of an exterior surface of the outer layer 62 of the laminated fibrous material of which the construct 10 is made. The exterior surface 42 is exposed to the environment external to the construct 10 and is not directly exposed to or in contact with the food item 44, optional oil-producing substance 46, and/or other oils, juices, etc. contained in the interior space 38. The exterior surface is readily visible to users. Accordingly, indicia can be provided on the exterior surface 42 preferably in areas corresponding to the locations of the top panel 28 and the base panel 34. For example, various indicia can identify the food item 44 contained in the construct 10, provide instructions for proper use of the construct 10, and/or provide heating instructions for the food item 44.

Figure 2:
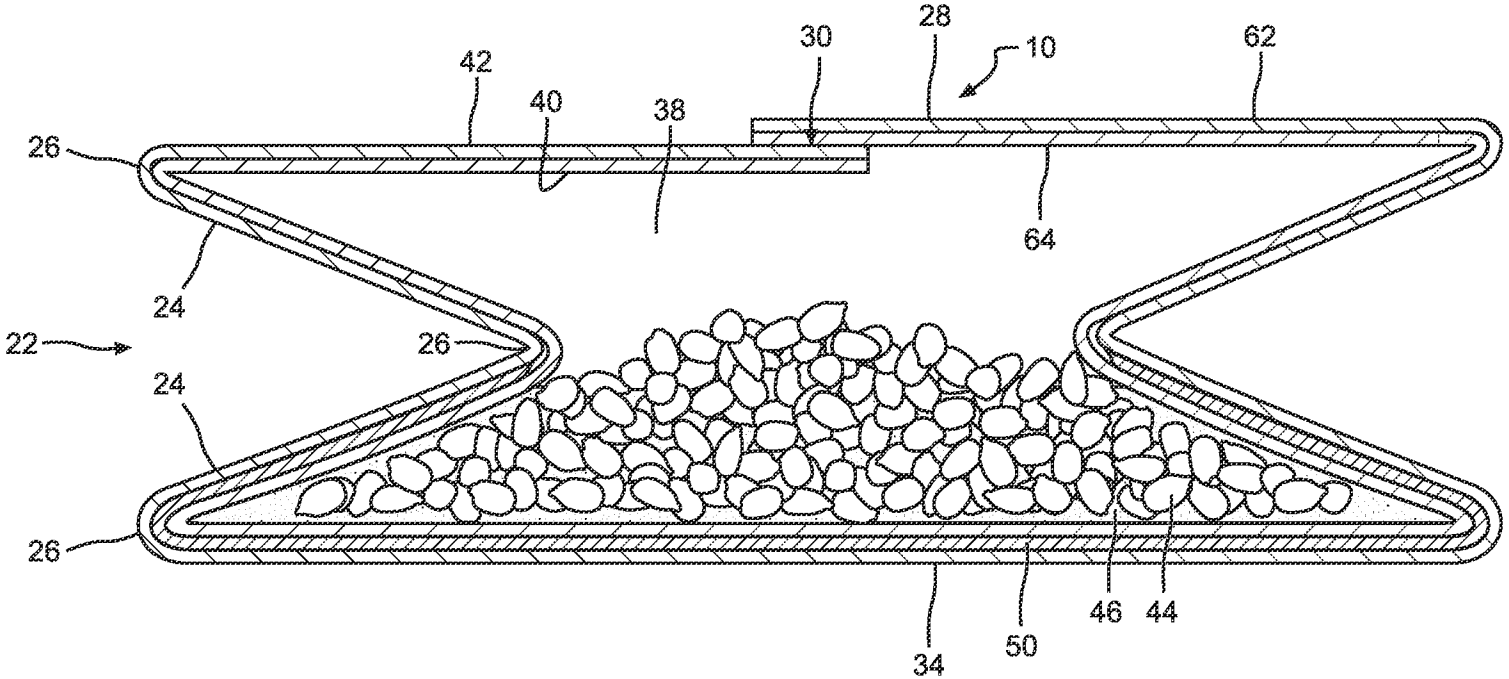
FIG. 2 is cross-sectional end view of a microwave food construct comprising a microwave popcorn bag and microwave susceptor taken along line 2-2 of FIG. 1 in accordance with an example embodiment.

As shown in FIGS. 1-2, following manufacture and prior to use the example construct 10 in the form of a microwave popcorn bag can be relatively compact and can have a relatively flat unexpanded profile. The popcorn kernels or other food item 44 to be heated and the optional oil-producing substance 46 are introduced into the interior space 38 of the construct 10 during the manufacturing process and are positioned so to be supported on and in contact with an area of the interior surface 40 that corresponds to the location of the base panel 34. As described further herein, a thin microwave susceptor film 50 is laminated in the base panel 34 and thus also supports the popcorn kernels or other food item 44 and the optional oil-producing substance 46. The popcorn kernels or other food item 44 and the oil-producing substance 46 if included may also be in contact with areas of the interior surface 40 that correspond to locations of one or both of the first and second side panels 22 that are near or adjacent to the base panel 34. The popcorn kernels or other food item 44 and optional oil-producing substance 46 in the interior space 38 of the construct 10 may be in contact with the interior surface 40 of the inner layer 64 of fibrous material for a substantial length of time during transit and/or storage of the construct 10 before the construct 10 is put to use.

Figure 3:
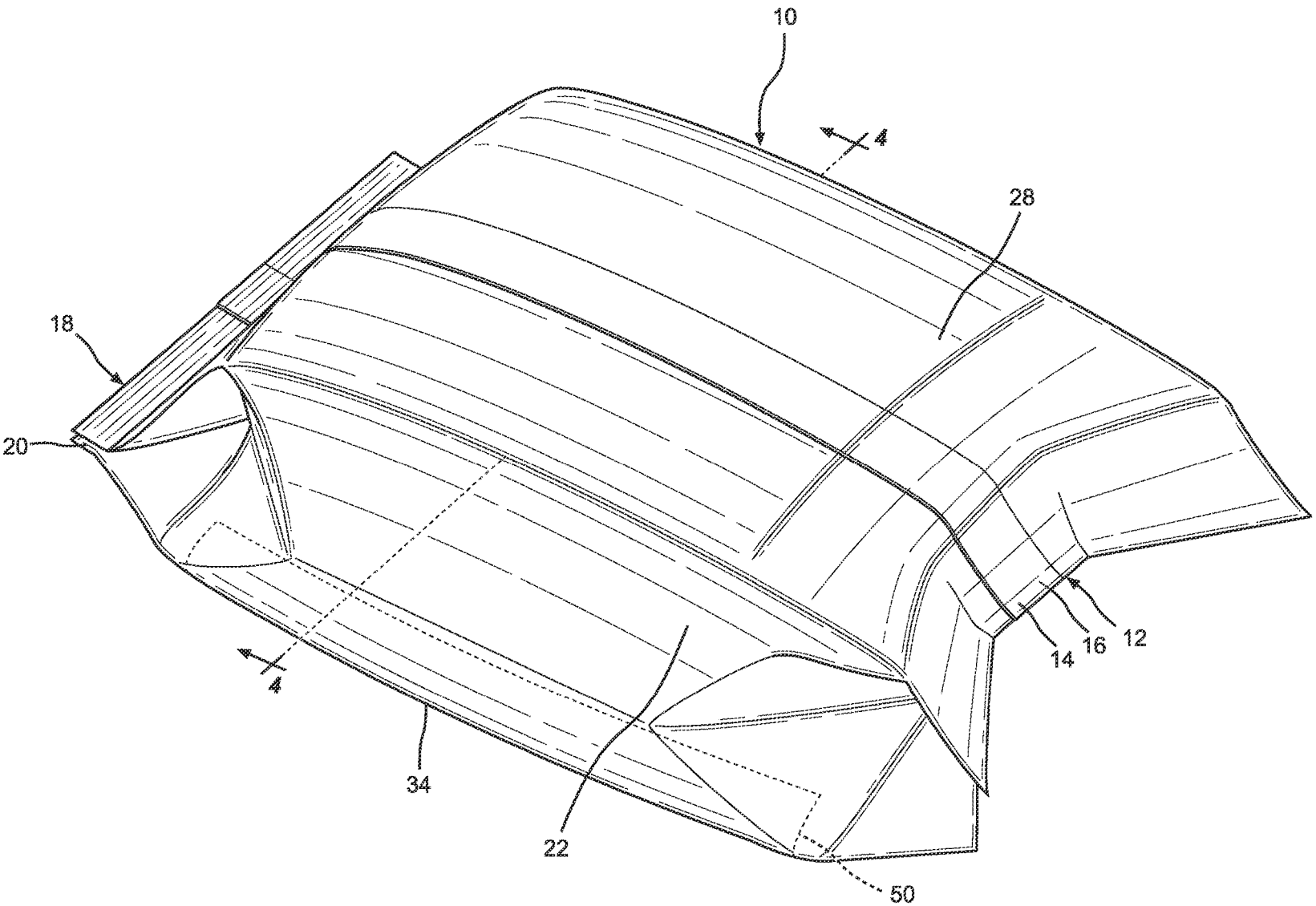
FIG. 3 is another perspective view of a microwave food construct comprising a microwave popcorn bag and microwave susceptor in accordance with an example embodiment with the bag fully expanded.
Figure 4:
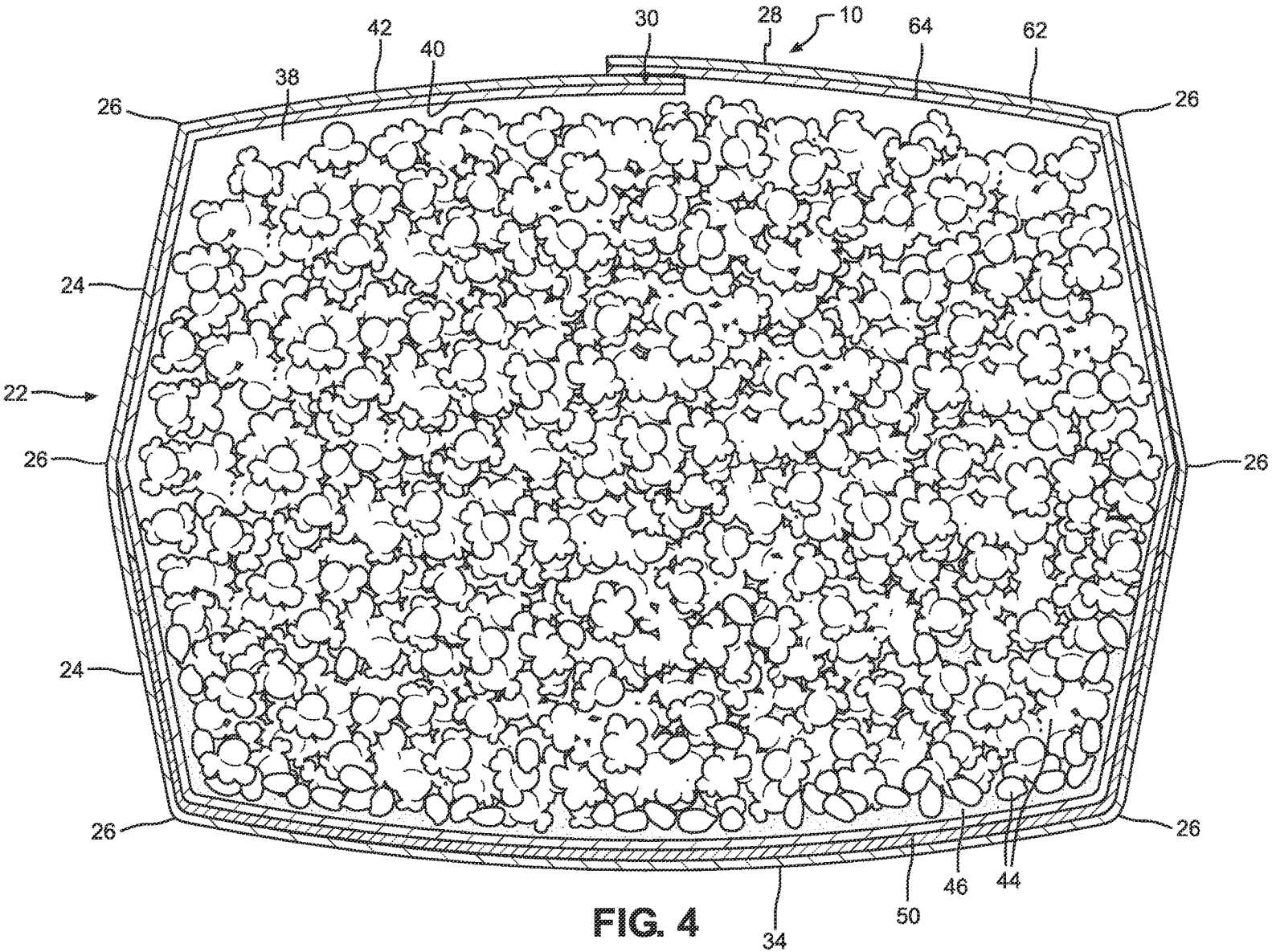
FIG. 4 is cross-sectional end view of a microwave food construct comprising a microwave popcorn bag and microwave susceptor taken along line 4-4 of FIG. 3 in accordance with an example embodiment.

When the popcorn kernels or other food item 44 are to be heated, the construct 10 is placed on a platform in a microwave oven and is oriented with the base panel 34 and microwave susceptor film 50 supported on the platform and the popcorn kernels and optional oil-producing substance supported on the base panel 34, including the microwave susceptor film 50. The microwave susceptor film 50 is functional to receive microwave energy from the microwave oven and to apply heat to the popcorn kernels or other food item 44 and the optional oil-producing substance 46 in the construct 10. As the popcorn kernels are heated and pop, gases are generated in the interior space 38 of the construct 10. The popped kernels also increase in volume and begin to fill the interior space 38. Accordingly, as shown in FIGS. 3-4, the example construct 10, including the interior space 38, is preferably made expandable to accommodate the expansion of the gases and the volume of the popped kernels. However, it will be appreciated that food items 44 different than popcorn may not require the construct 10 to be expandable or may require a lesser or greater degree of expandability. Accordingly constructs 10 exhibiting no or varying degrees of expansion are contemplated and are intended to be within the scope of the present disclosure.

The example construct 10 and the volume of the interior space 38 are made expandable by having each of the first and second side panels 22 of the construct 10 comprise a foldable and expandable gusset structure. As shown in FIGS. 1-4, an example gusset can comprise multiple fold areas or portions 24 and multiple fold lines 26 between the top panel 28 and the base panel 34. In the particular example embodiment illustrated, each gusset includes a first fold area 24 that is adjacent to the top panel 28 and a second fold area 24 that is adjacent to the base panel 34. Each of the first and second fold areas 24 extends substantially the entire distance between the first end portion 12 and the second end portion 18 of the construct 10. Each gusset also includes three substantially parallel fold lines 26 that are located between the top panel 28 and the base panel 34 and that extend substantially the entire distance between the first end portion 12 and the second end portion 18 of the construct 10. The first fold line 26 is adjacent to the top panel 28 and essentially joins the top panel 28 to a respective side panel 22. The second fold line 26 is adjacent to the base panel 34 and essentially joins the base panel 34 to the same respective side panel 22. The third fold line 26 is located between the first and second fold lines 26 and between adjacent fold areas 24 and essentially joins the adjacent fold areas 24 together.

As shown in FIGS. 1-2, prior to heat being applied, the example construct 10 has a relatively flat and compact profile with the fold areas 24 of the gussets in each of the first and second side panels 22 being substantially folded in on each other along the fold lines 26. The top panel 28 and bottom panel 34 are relatively closely spaced, and the interior space 38 of the construct 10 has a relatively small interior volume which is sufficient to contain the unheated popcorn kernels or other food item 44 and the optional oil-producing substance 46 in contact with and supported on the base panel 34 and the microwave susceptor film 50. The unheated popcorn kernels and the optional oil-producing substance may also be in contact with at least portions of one or both of the gusset structures in the first and second side panels 22, e.g., the fold areas 24 and fold lines 26 that are located near or adjacent to the base panel 34.

As the popcorn kernels or other food item 44 and the optional oil- producing substance 46 are heated in a microwave, the kernels pop, gases are generated, and the popped kernels begin to expand and fill the interior space 38. As shown in FIGS. 3-4, the resulting pressure pushes outward from the interior space 38 of the construct 10 against the interior surface 40 and causes the fold areas 24 of the gussets in each of the first and second side panels 22 to unfold from each other along the respective fold lines 26 and the side panels 22. This also causes the side panels 22, the top panel 28, and the base panel 34 to move outwardly away from each other and the volume of the interior space 38 to expand until the construct 10 is substantially completely expanded as shown in FIG. 4.

It will be appreciated that while one example of a suitable gusset structure is described, smaller or larger gusset structures comprising fewer or more fold areas 24 and fold lines 26 may be used depending on the degree to which it is desired for the construct 10 to be expandable. Further, the gusset structures may occupy a greater or smaller portion of the first and second side panels 22. Still further, the gusset structures may be included in both the first and second side panels 22 or only in one of the side panels 22. All such variations are contemplated and are thus intended to be included within the scope of the present disclosure.

It also will be appreciated that during the heating process, at least a portion of the popcorn kernels or other food item 44, the oil-producing substance 46 if present, and/or other oils, oil-containing liquids, and/or juices resulting from heating the food item 44 are likely to remain or come in contact with areas of the interior surface 40 that correspond to the base panel 34 and the gussets of the side panels 22 that are adjacent to the base panel 34, including one or more fold areas 24 and fold lines 26. Accordingly, these areas are at increased risk of being penetrated and of leakage occurring. As described further below, the microwave susceptor film 50 is preferably configured and arranged in the base panel 34 and areas of the side panels 22 that are near or adjacent to the base panel 34 to resist penetration into and through the fibrous material of the construct 10 by such oils, liquids, and/or other juices in these locations.

As shown in FIG. 1, prior to the construct 10 being used the first end portion 12 and the second end portion 18 are substantially closed by the first end portion seal 14 and the second end portion seal 20 respectively. This substantially seals the interior space 38 of the construct 10 from the external environment and prevents contamination of the popcorn kernels or other food item 44 prior to use. As shown in FIG. 3, where the construct 10 is in the form of a microwave popcorn bag for heating popcorn kernels, the first end portion seal 14 will preferably have or will produce during the heating process a first end portion opening 16 that allows gases generated in the interior space 38 during the heating process to be vented and to escape. Also preferably, the first end portion opening 16 is easily expanded when the heating process is completed to allow a consumer easy access to the heated popcorn or other food item 44 inside the construct 10.

Accordingly, during the manufacturing process of the construct 10, the first end portion seal 14 initially may be adhered closed continuously or discontinuously across all or a portion of the distance it extends between the first and second side panels 22 with an appropriate non-toxic food grade sealant. In at least one portion of the seal 14, the sealant will preferably be thinner or otherwise less adherent so that as the popcorn kernels pop and the bag expands, the forces acting to pull the seal 14 open will overcome the sealing force of the temporary sealant and produce or expand the top opening 16 in the seal 14 to allow the gases to escape. The sealing force provided by the temporary sealant to the remainder of the seal 14 is preferably weak enough so that when the heating process is completed, a consumer can easily expand the top opening 16 and open the seal 14 to gain access to the contents of the construct 10.

In contrast to the first end portion seal 14, the second end portion seal 20 is preferably permanently sealed with a suitable non-toxic food grade sealant. It will be appreciated however that instead of the first end portion seal 14 being provided with a first end portion opening 16 for venting gases and accessing the contents of the construct 10, the second end portion seal 20 may be provided with an opening in the same manner and for the same uses. Both variations are contemplated and are considered to be within the scope of the disclosure herein.

For the reasons explained herein, the fibrous material from which the construct 10 is made preferably is not treated with a fluorocarbon (FC)-containing chemical to provide resistance to oil and grease penetration. However, one or more surfaces of the fibrous material can be treated, coated, or otherwise provided with a thin layer or coating of a non-toxic oil-resistant substance such as a wax or waxy substance in one or more selected areas 32 to help resist oil and grease penetration in those areas.

Figure 5A:
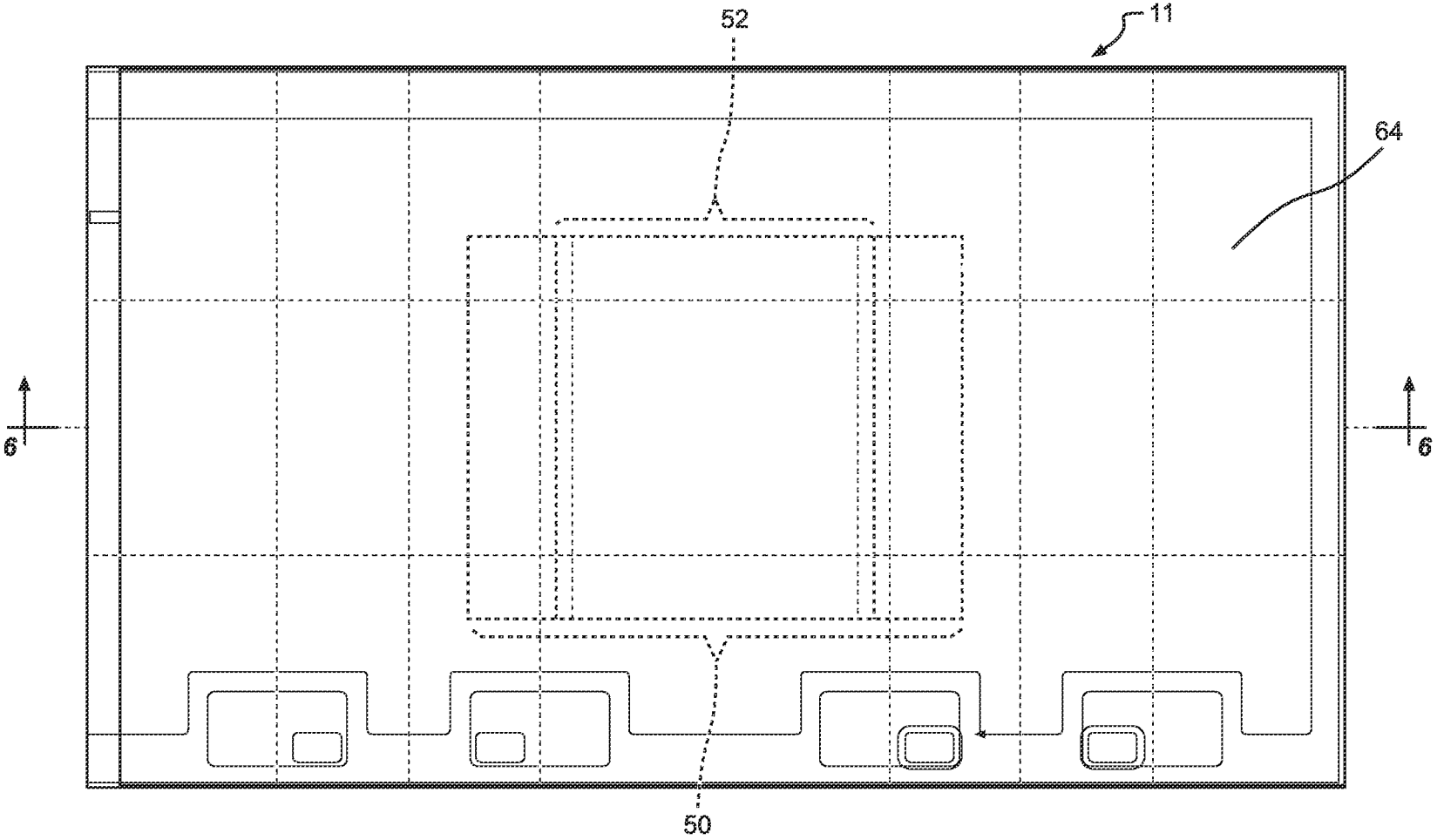
FIG. 5A is a top view of a blank for constructing a microwave food construct comprising a microwave popcorn bag and microwave susceptor in accordance with an example embodiment.
Figure 5B:
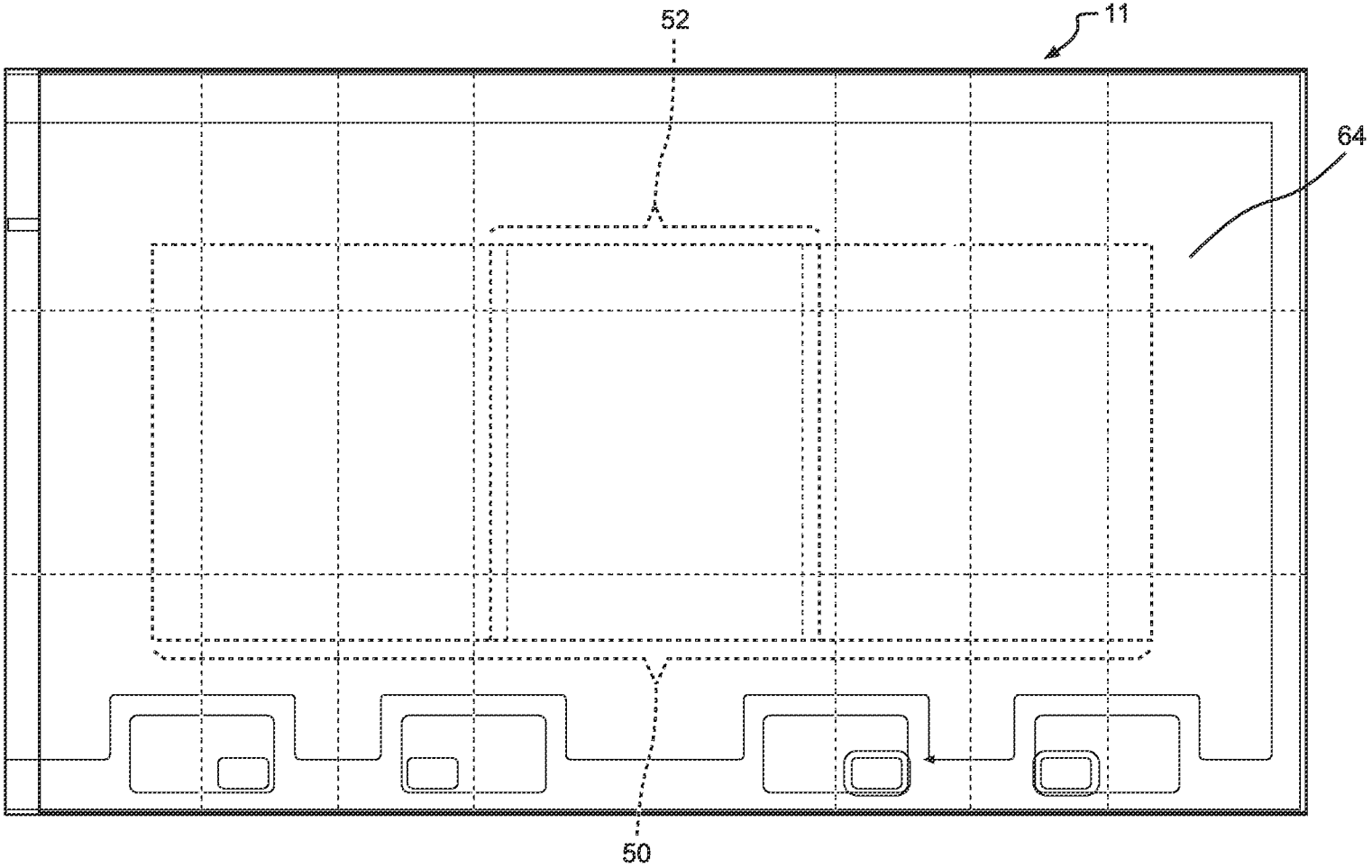
FIG. 5B is a top view of another blank for constructing an alternative embodiment of a microwave food construct comprising a microwave popcorn bag and microwave susceptor in accordance with an example embodiment.
Figure 5C:
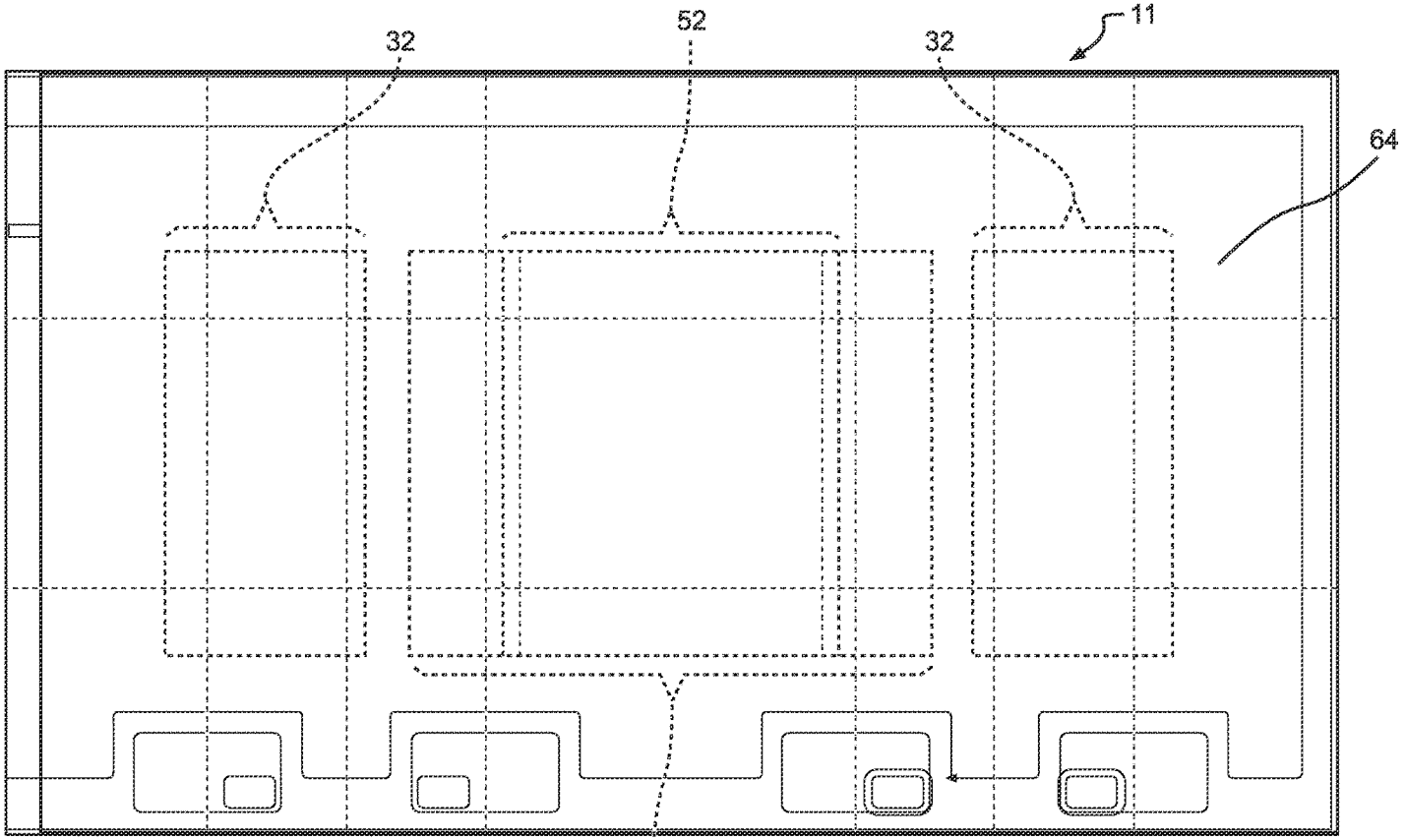
FIG. 5C is a top view of yet another blank for constructing another alternative embodiment of a microwave food construct comprising a microwave popcorn bag and microwave susceptor in accordance with an example embodiment.
Figure 6:
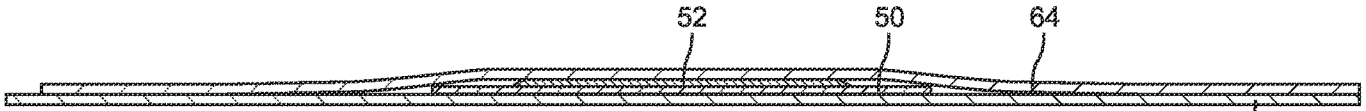
FIG. 6 is a cross-sectional view of the blank for a microwave food construct comprising a microwave popcorn bag and microwave susceptor taken along line 6-6 in FIG. 5 in accordance with an example embodiment.
Figure 7:
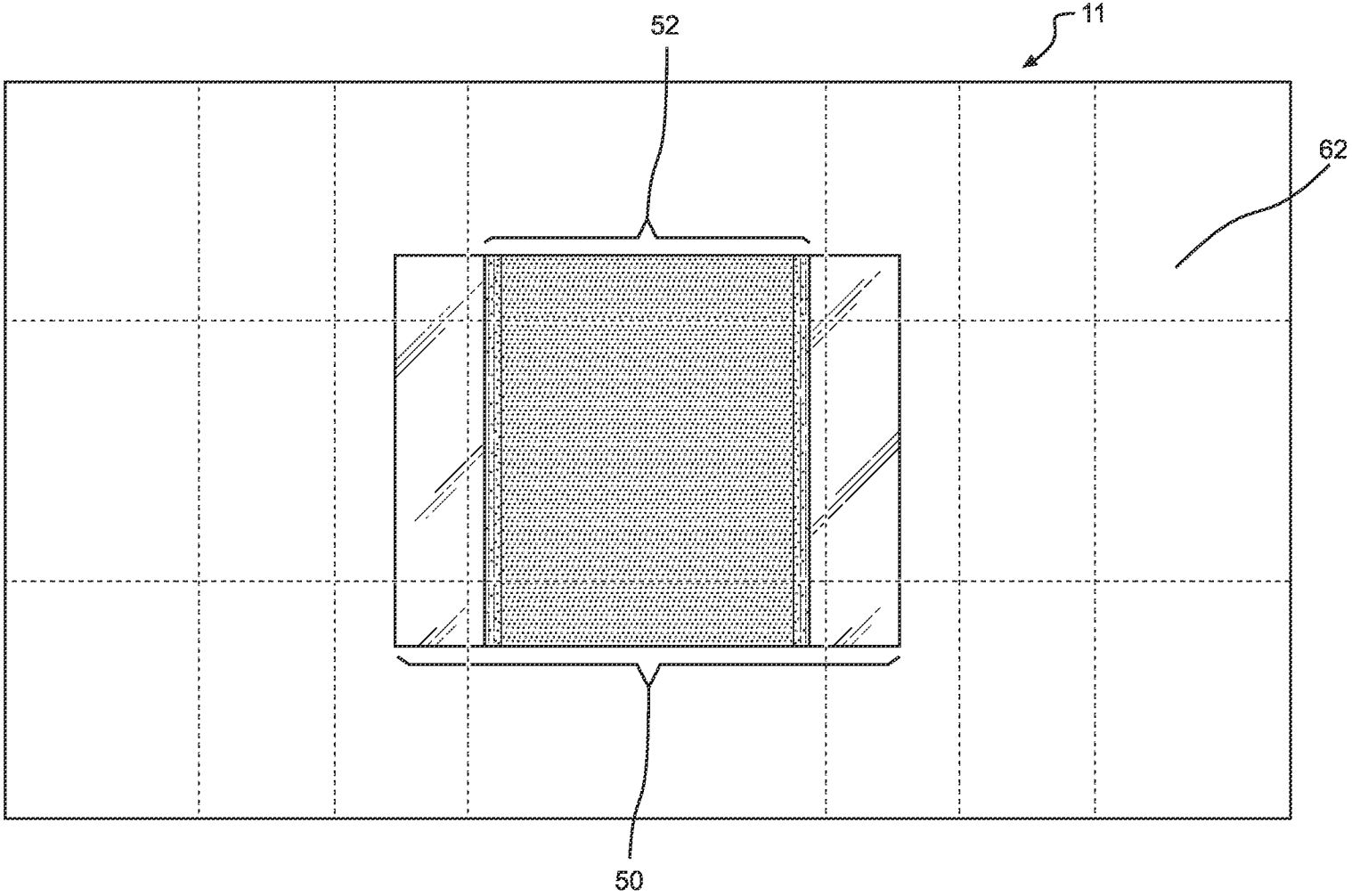
FIG. 7 is another top view of the blank for a microwave food construct comprising a microwave popcorn bag and microwave susceptor of FIG. 5 in accordance with an example embodiment with an inner layer of fibrous material removed to reveal the susceptor film.
Figure 8:
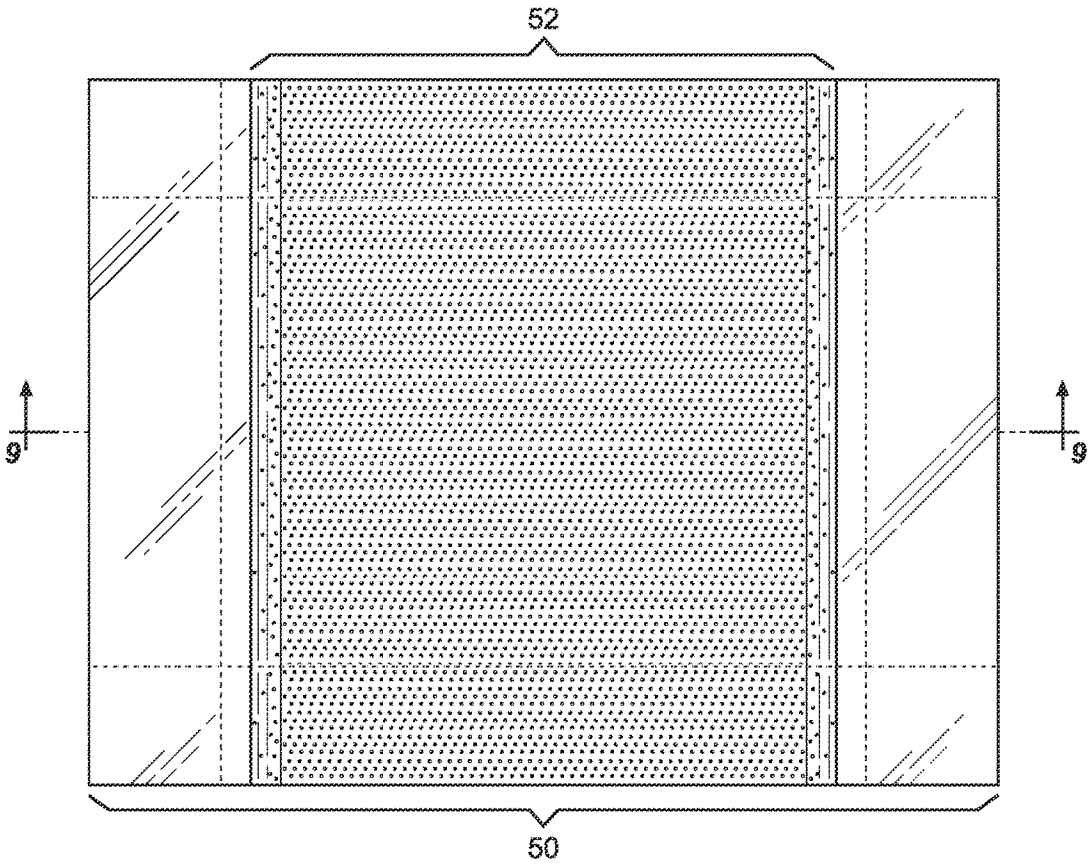
FIG. 8 is a top view of a susceptor film for a microwave food construct comprising a microwave popcorn bag and microwave susceptor in accordance with an example embodiment.
Figure 9:
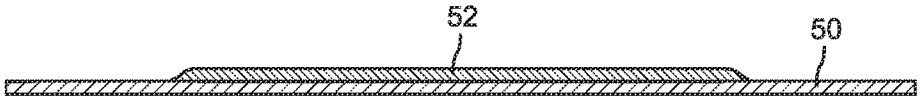
FIG. 9 is a cross-sectional view of the susceptor film for a microwave food construct comprising a microwave popcorn bag and microwave susceptor of FIG. 8 taken along line 9-9 in FIG. 8 in accordance with an example embodiment.

For example, a coating of such a substance can be applied to the interior surface 40 of the inner layer 64 of fibrous material in one or more selected areas 32, e.g., areas that correspond to the fold areas 24 and fold lines 26 in side panels 22, that may be more susceptible to oil and grease penetration than other areas. If used, the substance is preferably provided in areas 32 where the microwave susceptor film 50 is not present. The substance thus provides protection against penetration of the fibrous material in these areas in addition to the microwave susceptor film 50 as described herein. For example, FIG. 5C shows a top view of a blank 11 for a construct 10 in which the substance is provided in areas 32 that are relatively closely spaced laterally from edges of the microwave susceptor film 50 but do not abut or overlap the microwave susceptor film 50. It is contemplated that in other embodiments, the substance may be provided in one or more areas 32 and that one or more of the areas 32 may substantially abut one or more edges of the microwave susceptor film 50.

As further shown in FIG. 5C, the substance may be provided in areas 32 that encompass all of the fold areas 24 and fold lines 26 in the side panels 22 where the microwave susceptor film 50 is not present and may even extend into the top panel 28. It is contemplated that in various other embodiments, the substance may be provided in one or more areas 32 and that one or more of the areas 32 may extend laterally across some or all of the fold areas 24 and fold lines 26 between the base panel 34 and the top panel 28 where the microwave susceptor film 50 is not present. It is further contemplated that in some embodiments the substance may be provided in one or more areas 32 that extend partially or substantially the entire length of one or both side panels 22 between the first end portion 12 and the second end portion 18 of the construct 10.

It will be appreciated that while the example embodiment of the construct 10 has a generally box-like configuration with four substantially rectangular panels, other configurations are also possible and will benefit from the features disclosed herein. For example, an alternative configuration could have a substantially circular or otherwise rounded base panel 34 with a single continuous side panel 22 that extends substantially around the periphery the base panel 34. The side panel 22 could be non-expandable, expandable with a plurality of defined fold areas 24, or even expandable without defined fold areas 24. This and other alternative configurations that are consistent with and can employ one or more of the various features described herein are contemplated and considered to be within the scope of the disclosure.

C. Microwave Susceptor Film.

As shown in FIGS. 2, 4, 5A-5B, 6 and others, the construct 10 includes a thin microwave susceptor film 50. The microwave susceptor film 50 is laminated between the outer and inner layers 62, 64 of fibrous material from which the construct 10 is made, and is located in the base panel 34 and in at least portions of the side panels 22 that are near or adjacent to the base panel 34. The microwave susceptor film 50 and the inner and outer layers of fibrous material 62, 64 can be adhered together and laminated using thin layers of a non-toxic food grade adhesive that has suitable adherence and thermal properties for use in the microwave food heating applications contemplated herein.

The microwave susceptor film 50 preferably comprises a thin film of non-toxic food grade material that is resistant to penetration by oil, grease, and other oil-containing juices and liquids. In addition, the microwave susceptor film 50 preferably comprises an environmentally friendly, biodegradable cellulosic material, most preferably a thin cellophane film. Other thin film materials are also suitable, including thermoplastic polymers such as polyethylene terephthalate (also known as PET or polyester), various other polyesters, and the like, however these materials are less preferred because they are not as environmentally friendly or biodegradable as cellulose-based thin films like cellophane.

The microwave susceptor film 50 has a first surface and a second surface that is arranged opposite to the first surface. A microwave interactive material 52 is present on one of the first and second surfaces. When the microwave susceptor film 50 is laminated with the fibrous material, the microwave interactive material 52 preferably is adjacent to and in contact with the inner layer 64 of the fibrous material. As described further herein, the microwave interactive material 52 occupies only a portion of one of the first and second surfaces and not the entire area of the surface.

The microwave interactive material 52 preferably comprises a thin coating of aluminum or another suitable metal. Alternatively, the microwave interactive material 52 can comprise certain ceramic or other materials that are capable of converting microwave energy to thermal energy. In the case of a metal material, such as aluminum, the microwave interactive material 52 can be applied directly to a surface of the microwave susceptor film 50 by spray coating, vacuum deposition, direct printing, or another suitable process. Such processes may also include de-metallization processes. Although in the present example embodiment such processes are less preferred, it is contemplated that such processes may be more useful in other embodiments and therefore both direct application processes and de-metallization processes are intended to be encompassed within the scope of the present disclosure.

Similarly, in the present example embodiment, i.e., a microwave popcorn bag, the microwave interactive material 52 need not be patterned. However, it is contemplated that a patterned microwave interactive material 52 could be useful in other applications involving other types of food items 44 and other types of constructs 10. Accordingly, both unpatterned and patterned microwave interactive material 52 is intended to be encompassed within the scope of the present disclosure.

The microwave interactive material 52 functions to receive microwaves from a microwave source, e.g., a microwave oven, and to convert the microwave energy to heat. Accordingly, the construct 10 can be placed in a microwave oven with the base panel 34 supported on a platform in the oven and the popcorn kernels or other food item 44 and optional oil-producing substance 46 to be heated supported on and in contact with the base panel 34 above the microwave susceptor film 50 as described herein. When the microwave source is activated, the microwave interactive material 52 absorbs the microwave energy, converts it to heat, and applies the heat to the popcorn kernels or other food item 44 and to the optional oil-producing substance 46.

The microwave susceptor film 50 also functions to resist oils, grease, etc. from the popcorn or other food item 44 and the optional oil-producing substance 46 that are contained in the construct 10, as well as oils, juices, etc. that may be produced during a heating process, from penetrating into and through the fibrous material of the construct 10 during transit, storage, and use of the construct 10. Accordingly, as described further herein, the microwave susceptor film 50 is preferably configured to be present in the areas of the construct 10 in which such oils, grease, etc. are likely to be in contact with the fibrous material and where the fibrous material is more susceptible to penetration and leakage, e.g., the base panel 34 and portions of the side panels 22 that are near or adjacent to the base panel 34.

As shown generally in FIGS. 1-4 and in more detail in FIGS. 5A-5C, 7-9, and 10A, in the example embodiment the microwave susceptor film 50 is formed in a substantially rectangular shape with four peripheral side edges, which for identification purposes only are referred to here as top and bottom edges and first and second side edges. The top and bottom edges are arranged opposite each other and the first and second side edges are arranged opposite each other. Similarly, the microwave interactive material 52 is formed in a substantially square or slightly rectangular shape with opposed top and bottom edges and opposed first and second side edges. The top and bottom edges of the microwave interactive material 52 can be but are not necessarily substantially co-extensive with the corresponding top and bottom edges of the microwave susceptor film 50. The microwave interactive material 52 extends laterally over only a portion of the surface area of the microwave susceptor film 50 such that the opposed first and second side edges of the microwave interactive material 52 are recessed inwardly from the corresponding first and second side edges of the microwave susceptor film 50. In other words, the microwave susceptor film 50 extends laterally beyond the opposite first and second side edges of the microwave interactive material 52 such that the portions of the surface area of the microwave susceptor film 50 that are at or near the opposite first and second edges of the microwave susceptor film 50 have no microwave interactive material 52.

Also as described generally above and as shown in detail in FIGS. 5A-5C, 6-9, and 10A, the microwave susceptor film 50 is laminated between the inner and outer layers 62, 64 of fibrous material in an area that corresponds to the base panel 34 and the first and second side panels 22 of the construct 10. The microwave susceptor film 50 is oriented and arranged in the base panel 34 with the opposite first and second side edges of the microwave interactive material 52 substantially facing the opposite first and second side panels 22 of the construct 10. A unique feature of the microwave susceptor film 50 is that the microwave susceptor film 50 extends laterally across the base panel 34 into one or both of the first and second side panels 22, and upwardly along the first and second side panels 22 toward the top panel 28. More specifically the microwave susceptor film 50 extends laterally across one or more fold lines 26 and into one or more fold areas 24 of the gussets of the side panels 22 that are near or adjacent to the base panel 34. The microwave susceptor film 50 acts as a barrier to resist penetration of oil, grease, and/or other juices into and potentially through the fibrous material of the construct 10 in those areas, which are particularly susceptible to such penetration.

The portion of the microwave susceptor film 50 that includes the microwave interactive material 52 is contained completely in the base panel 34. The microwave interactive material 52 does not cross any fold lines 26 and does not extend into the side panels 22 of the construct 10. The reason is that the presence of microwave interactive material 52 in folded or creased areas of the construct 10 could concentrate too much heat in those areas which could result in burning of the popcorn or other food item 44 in those areas and possible charring or burning of the fibrous material. However, it is preferred to maximize the distance the microwave interactive material 52 extends laterally in the base panel 34 between the first and second side panels 22 without crossing the fold lines 26 between the base panel 34 and first and second side panels 22. That is preferably accomplished by tapering, fading or thinning the microwave interactive material 52 on the surface of the microwave susceptor film 50 at or near its opposite first and second side edges until no microwave interactive material remains near or at the fold lines 26. In other words, only the oil-resistant material, e.g., cellophane, of the microwave susceptor film 50 remains in those areas.

Figure 10A:
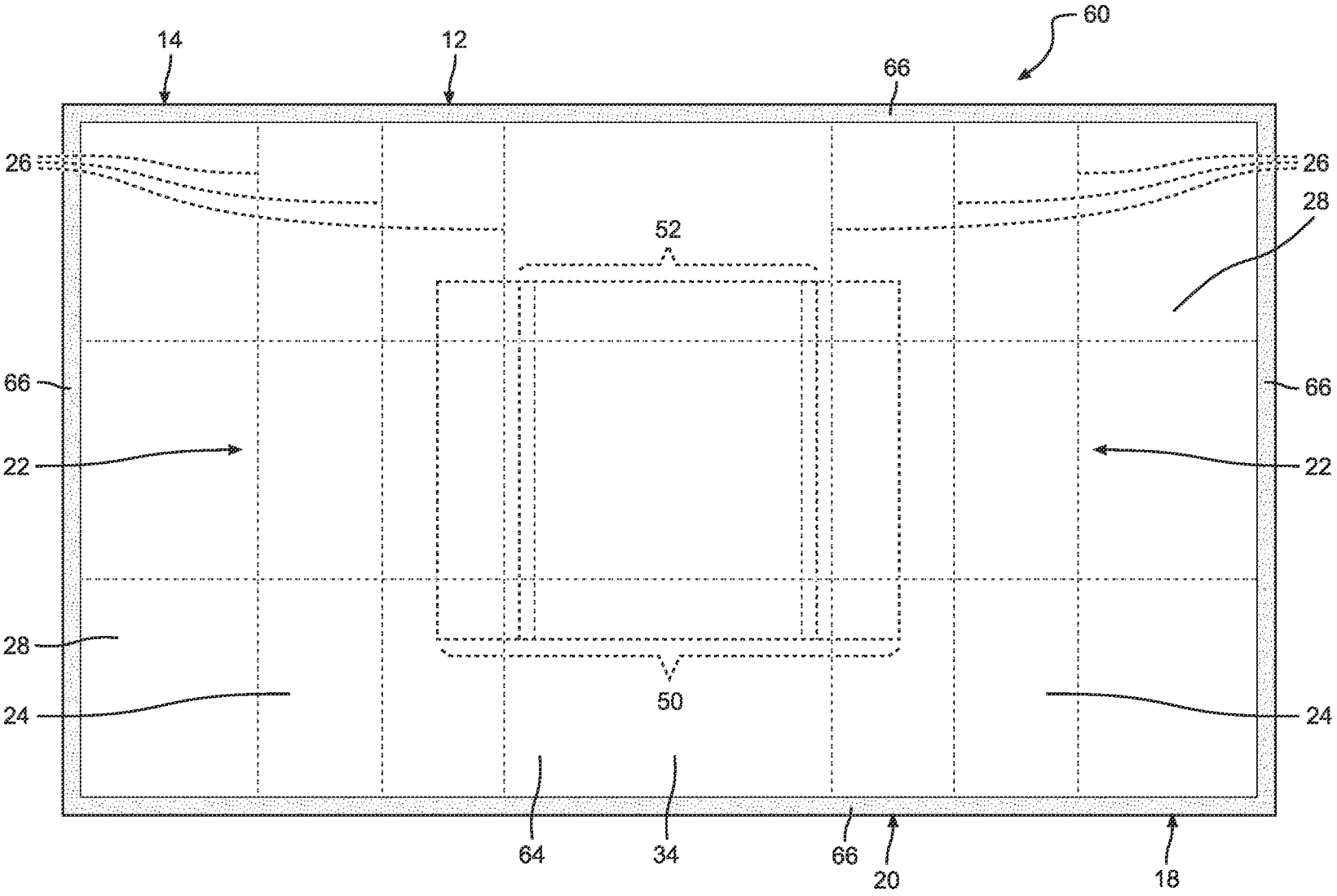
FIG. 10A is a top view of a blank for constructing a microwave food construct comprising a microwave popcorn bag and microwave susceptor in accordance with an example embodiment as cut from a continuous stock showing various fold lines and susceptor locations in dotted lines.

In the example embodiment of FIGS. 1-4, the microwave susceptor film 50 extends partially into the first and second side panels 22 across the fold lines 26 and into the fold areas 24 of the gussets that are near or adjacent to the base panel 34. FIGS. 5A and 10A show a top view of a blank 11 for the construct 10 having this configuration of the microwave susceptor film 50. It is contemplated that in other embodiments, the microwave susceptor film 50 could extend into only one of the first and second side panels 22. It is also contemplated that the microwave susceptor film 50 could extend a different distance into either or both of the side panels 22 across some or all of the fold areas 24 and fold lines 26 of the gussets. FIG. 5B shows a top view of a blank for a construct in which the microwave susceptor film 50 extends into and across substantially all of the fold areas 24 and fold lines 26 of the gussets in the first and second side panels 22 and continues into the top panel 28. It is thus contemplated that in various embodiments, the microwave susceptor film 50 could extend into one or both of the side panels 22 and across more or fewer of the fold areas 24 and fold lines 26 of the gussets of the side panels 22 than is shown in the example embodiment of FIGS. 1-4 and accordingly all such variations are considered to be within the scope of the disclosure.

Figure 10B:
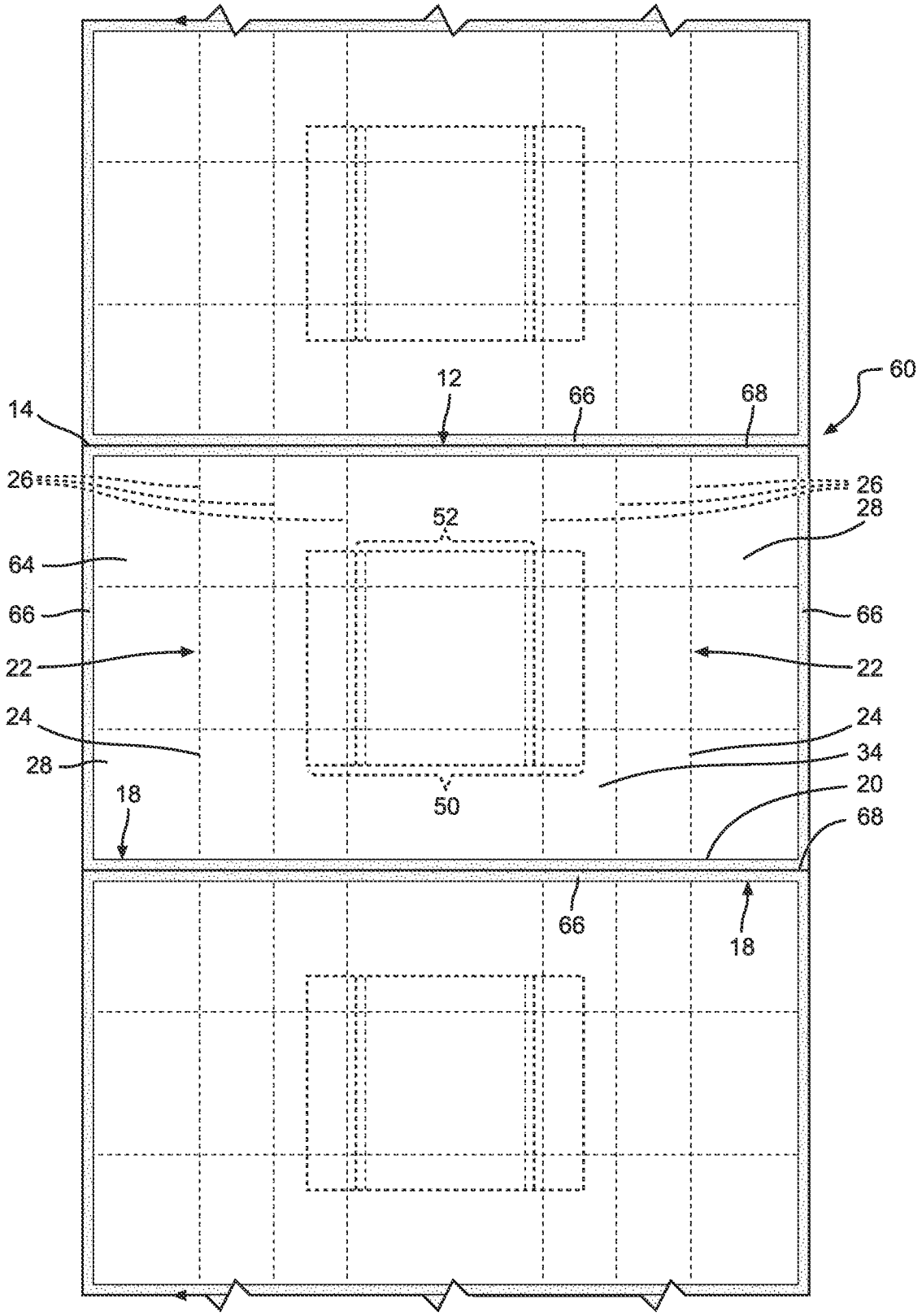
FIG. 10B is a top view of a continuous stock for constructing a plurality of microwave food constructs comprising microwave popcorn bags and microwave susceptors in accordance with an example embodiment from which the blank of FIG. 10A can be cut.
Figure 10C:
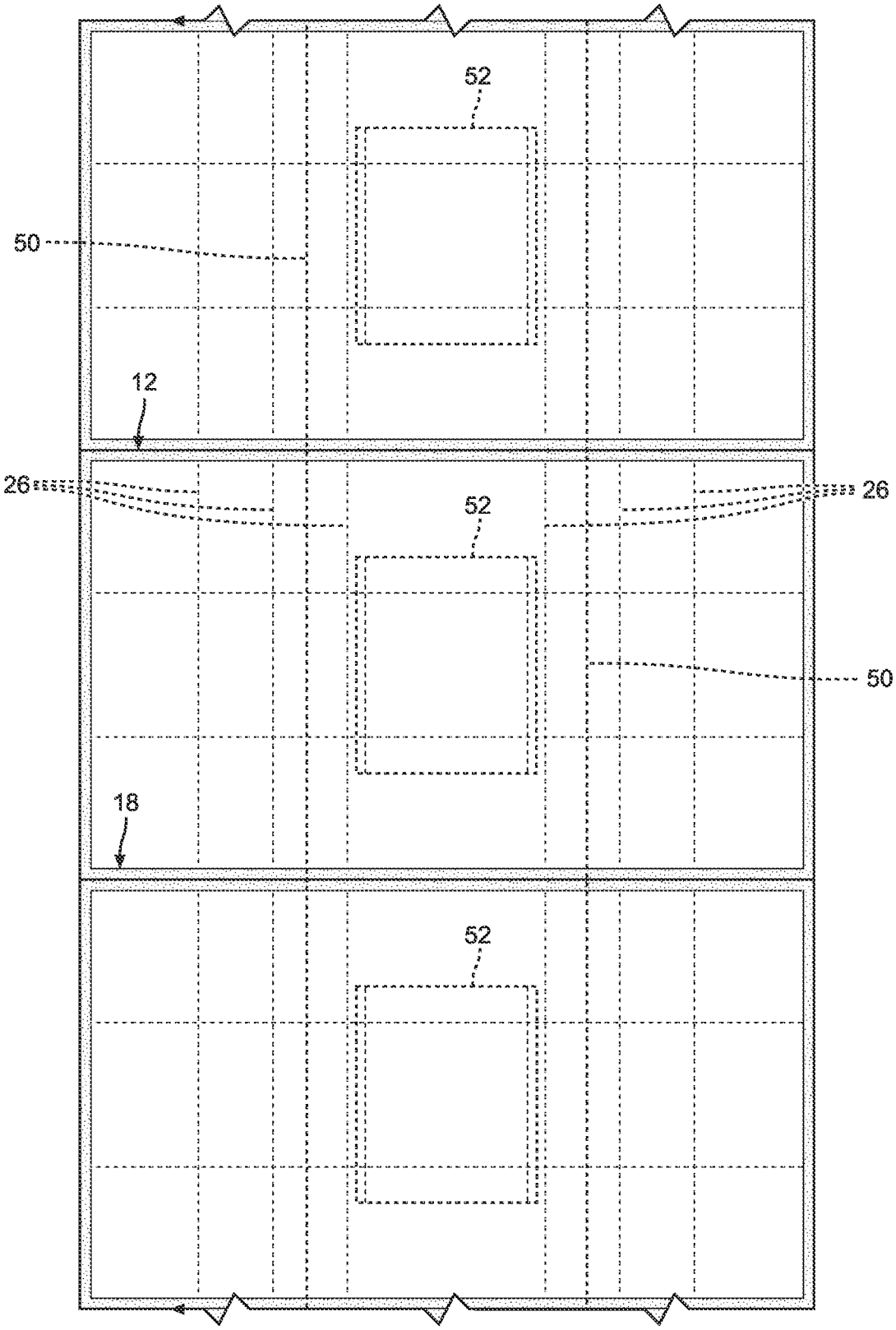
FIG. 10C is a top view of another continuous stock for constructing a plurality of microwave food constructs comprising microwave popcorn bags and microwave susceptors in accordance with an alternative example embodiment from which blanks for constructing individual bags can be cut.

Also, in the example embodiment shown in FIGS. 1-4, the microwave susceptor film 50 extends only partially along the first and second side panels 22 between the first end portion 12 and the second end portion 18 of the construct 10. Blanks 11 for constructing this example embodiment are shown in FIGS. 5A and 10A. However, it is contemplated that in another example embodiment, the microwave susceptor film 50 can extend along the first and second side panels 22 substantially the entire distance between the first end portion 12 and the second end portion 18 and blanks 11 for constructing this example embodiment are shown in FIG. 10C. It is contemplated and will be appreciated that in other embodiments, the microwave susceptor film 50 can extend along the first and/or second side panels 22 for any selected distance between the first and second end portions 12, 18.

As described above, in use the base panel 34 of the construct 10 is supported on a platform in a microwave oven. As the microwave interactive material 52 of the microwave susceptor film 50 receives microwaves and applies heat to the popcorn or other food item 44 and optionally to the oil-producing substance 46 in the construct 10, the fold areas 24 of the gussets in the opposed first and second side panels 22 of the construct 10 begin to unfold outward along the fold lines 26 as the construct 10 expands. As the fold areas 24 fold outward, the microwave susceptor film 50 forms an elongated substantially U-shaped tray structure within the construct 10 as best shown in FIGS. 1-4. The bottom of the tray extends both longitudinally and laterally along the base panel 34 between the opposed first and second side panels 22. The bottom of the tray comprises the portion of the surface of the microwave susceptor film 50 that includes the microwave interactive material 52. The opposing legs or sides of the tray extend upward and longitudinally along the opposite first and second side panels 22 and more specifically across the fold lines 26 and the fold areas 24 that are near or adjacent to the base panel 34. The opposing legs or sides of the tray do not include any of the microwave interactive material 52 but are comprised of only the oil-resistant material of the microwave susceptor film 50, e.g., cellophane. Liquified oil from the oil-producing substance 46 if present as well as any other oils or juices that may result from heating the popcorn or other food item 44 can drip or run into the tray structure and collect there without coming in contact with or penetrating through the outer layer 62 of fibrous material of the construct 10. The microwave susceptor film 50 thus effectively resists penetration of the fibrous material of the construct 10 by oil, grease, and/or other liquids or juices in the areas of the construct 10 that are most susceptible to penetration.

It will be appreciated that although a particular example embodiment of the microwave susceptor film 50 is described, the microwave susceptor film 50 and its components can have different shapes and sizes than described, and can have different orientations and arrangements in the construct 10 than described provided that they are consistent with performing the functions and achieving the objectives described herein. All such variations are thus intended to be encompassed within the scope of the present disclosure.

D. Roll Stock.

As described above, the example construct 10 in the form of a microwave popcorn bag or shell is preferably constructed of a single piece of laminated fibrous material. As shown in FIGS. 10A-10C, the single piece of laminated material used to construct a single construct 10 can be cut from a continuous roll stock 60 of the laminated material as part of the manufacturing process.

All of the components for constructing a single construct 10 are contained in a substantially planar blank 11 as shown in FIGS. 5A-5C and 10A. As shown in FIGS. 1013 and 10C, the blank 11 can be repeated sequentially at spaced intervals in the continuous roll stock 60. For example, FIG. 10A shows the microwave susceptor film 50 with the interactive microwave material 52 laminated in the area of a single piece of the laminated material that corresponds to the base panel 34 of a single construct 10 when constructed. FIGS. 1013 and 10C show these components repeated sequentially at spaced intervals in the continuous roll stock 60. Similarly, FIG. 10A also shows adhesive areas 66 and locations for the fold areas 24 and fold lines 26 of the gussets of the opposed first and second side panels 22 that will be used to construct a single construct 10. FIGS. 10B and 10C show each of these components repeated sequentially at spaced intervals on surface areas of the continuous roll stock 60 that correspond to the interior surfaces 40 of multiple constructs 10.

Cut lines 68 are present at spaced intervals in the continuous roll stock 60 between sequential spaced areas that correspond to blanks 11 for single constructs 10. The roll stock 60 can be unwound from a reel or roller or can be fed otherwise. The sequential spaced areas that correspond to blanks 11 for individual constructs 10 are cut from the continuous roll at the cut lines 68, and the resulting single pieces of laminated material corresponding to individual constructs 10 can then be fed to an assembly line or to one or more individual work stations where the individual constructs 10 can be constructed.

As shown in FIGS. 10B and 10C, the entire continuous roll stock 60 is comprised of the multi-layer laminated material from which individual constructs 10 will be constructed. Thus, in the case of the present example embodiment the entire continuous roll stock 60 is comprised of a multi-layer laminate with the outer layer 62 of fibrous material, the inner layer 64 of fibrous material, and the microwave susceptor film 50 adhered and laminated between the inner and outer layers 62, 64.

It will be appreciated that while the inner and outer layers 62, 64 of fibrous material preferably will be continuous, the microwave susceptor film 50 may or may not be continuous. FIG. 10B shows an example embodiment in which a plurality of individual units or patches of the microwave susceptor film 50 are applied discretely to the continuous roll stock 60 at appropriate spaced intervals of distance corresponding to individual blanks 11 for individual constructs 10 by adhering them between the inner and outer layers 62, 64 of fibrous material using a suitable adhesive substance. FIG. 10C shows an alternative example embodiment in which the microwave susceptor film 50 comprises a continuous film that is adhered between the inner and outer layers 62, 64 of fibrous material and that extends continuously in a longitudinal direction, i.e., unwind direction of the roll stock 60, across a plurality of cut lines 68 and across a plurality of blanks 11 for forming individual constructs 10. In this embodiment, the continuous microwave susceptor film 50 comprises a plurality of discrete islands or patches of microwave interactive material 52. The discrete islands or patches of microwave interactive material 52 are spaced apart at appropriate intervals so that each discrete island or patch of material corresponds to an individual blank 11 of the plurality of blanks 11 comprising the roll stock 60.

Once a piece of the multi-layer laminate material corresponding to a single construct 10 is cut from the continuous roll stock 60, it can be used to make a finished construct 10. For example, referring to FIGS. 5A-5C and 10A, the piece of material can be folded inwardly along the fold lines 26 in the areas corresponding to the opposing first and second side panels 22 to form the fold areas 24 of the gussets of the first and second side panels 22 as shown in FIGS. 1-4. The opposite side edges of the piece of material are then brought together with the surface of the material corresponding to the exterior surface 42 of the construct 10 facing outward and the surface of the material corresponding to the interior surface 40 of the construct 10 facing inward. The opposite side edges of the piece of material are overlapped to form overlapping seam 30 and to create the top panel 28, base panel 34, and interior space 38 of the construct 10. The overlapped edges are permanently adhered together at adhesive areas 66 using a suitable non-toxic food grade adhesive.

Opposing surfaces of the top panel 28 and the base panel 34 near or at the second end portion 18 of the construct 10 are brought together to form the second end portion seal 20 and are permanently adhered at adhesive areas 66 with a suitable non-toxic food grade permanent adhesive. The popcorn kernels or other food item 44 and optional oil producing substance 46 are introduced into the interior space 38 through the open first end portion 12 of the construct 10 and are preferably placed on the interior surface 40 of the base panel 34 of the construct atop the microwave susceptor film 50 as shown in FIG. 2.

The opposing surfaces of the top panel 28 and the base panel 34 near or at the first end portion 12 of the construct 10 are then brought together to form the first end portion seal 14 and potentially a first end opening 16 and are temporarily adhered at adhesive areas 66 along all or a portion of the length of the seal with a suitable non-toxic food grade temporary adhesive. With the first end portion 12 sealed, the construct 10 is complete and the interior space 38 and the contents of the construct 10 are isolated from the external environment. If desired, the first end portion 12 and the second end portion 18 of the completed construct 10 may be folded inwardly over the top panel 28 or the base panel 34, for example along the horizontal dashed fold lines shown in FIGS. 5A-5C, 10A and others, in order to make the completed construct 10 more compact for packaging, shipment, and storage.

E. Operation of Preferred Embodiment.

In describing an example use of an example embodiment of the construct 10, it is assumed that the construct 10 is in the form of a microwave popcorn bag and that construction of the construct 10 has been previously completed as described above. To the extent the construct 10 has been folded into a more compact form as described above, the construct 10 is first unfolded into substantially the form shown in FIG. 1. The construct 10 is placed in a suitable microwave oven with the base panel 34 in contact with and supported on a platform. The microwave oven is then activated.

While the microwave oven is activated, the microwave interactive material 52 of the microwave susceptor film 50 receives microwave energy, converts the microwave energy to heat, and applies the heat to the popcorn kernels and oil-producing substance 46 in the interior space 38 of the construct 10. As the popcorn kernels and oil-producing substance 46 heat up, the kernels begin to pop, producing gases in the interior space 38 of the construct 10 and filling the interior space 38. The gases are allowed to vent at least partially through the first end portion opening 16 in the first end portion seal 14 and the outward forces produced in the interior space 38 cause the folding areas 24 of the gussets of the first and second side panels 22 to unfold outwardly and the construct 10 to expand as described herein and as shown in FIG. 3.

As the construct 10 expands, the microwave susceptor film 50 forms a substantially U-shaped tray on the base panel 34 and along portions of the first and second side panels 22 as shown in FIGS. 3-4. The tray collects oil, grease, and other juices that might be produced during the heating process and resists them coming into contact with and penetrating through the fibrous material of the construct 10.

The microwave oven can remain activated for a period of time suitable to cause substantially all of the popcorn kernels to pop. Upon completion of the heating process, the first end portion opening 16 can be expanded and the popcorn can be accessed and removed from the interior space 38 if desired for consumption.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. A construct for heating microwave popcorn, comprising:

an interior space with an interior volume;

a first panel with a surface for supporting popcorn kernels in the interior space;

a second panel adjacent to the first panel for containing the popcorn kernels in the interior space;

a third panel that is adjacent to the first panel and opposed to the second panel;

wherein each of the second panel and the third panel has an expandable portion;

wherein the construct is comprised of a fibrous material; and a microwave susceptor film in the first panel for receiving microwaves and applying heat to the popcorn kernels, wherein the microwave susceptor film comprises an oil-resistant material, and wherein the microwave susceptor film extends across the first panel into the second panel to resist oil penetrating through the fibrous material;

wherein the microwave susceptor film extends across the first panel into the expandable portion of each of the second panel and the third panel, and wherein when the expandable portion of each of the second panel and the third panel is expanded, and wherein the microwave susceptor film forms a tray structure with a bottom on the first panel and opposed sides along the second panel and the third panel.

2. A construct for heating microwave popcorn of claim 1, wherein the second panel has an expandable portion with a fold area near the first panel, and wherein the microwave susceptor film extends into the fold area.

3. The construct for heating microwave popcorn of claim 1, wherein the fibrous material comprises a laminate having an inner layer and an outer layer, and wherein the microwave susceptor film is between the inner layer and the outer layer.

4. The construct for heating microwave popcorn of claim 1, wherein the oil-resistant material comprises a biodegradable cellulose material.

5. The construct for heating microwave popcorn of claim 1, wherein the microwave susceptor film comprises a microwave interactive material, and wherein the microwave interactive material is only present in the first panel.

6. The construct for heating microwave popcorn of claim 1, wherein the expandable portion of the third panel has a fold area near the first panel, and wherein the microwave susceptor film extends into the fold area.

7. The construct for heating microwave popcorn of claim 1, comprising:

a first end portion and a second end portion, wherein the second end portion is spaced apart from and is opposite the first end portion;

wherein the second panel extends substantially the entire distance between the first end portion and the second end portion; and wherein the microwave susceptor film extends along the second panel substantially the entire distance between the first end portion and the second end portion.

8. The construct for heating microwave popcorn of claim 7, comprising a third panel that is adjacent to the first panel and opposed to the second panel, wherein the microwave susceptor film extends across the first panel into the third panel, wherein the third panel extends substantially the entire distance between the first end portion and the second end portion, and wherein the microwave susceptor film extends along the third panel substantially the entire distance between the first end portion and the second end portion.

9. The construct for heating microwave popcorn of claim 1, wherein the second panel includes an area where the surface of the fibrous material has an oil-resistant substance and the microwave susceptor film is not present.

10. A construct for heating microwave popcorn, comprising:

a base panel with a surface for supporting popcorn kernels to be heated;

a top panel substantially opposite to the base panel;

a first side panel between the base panel and the top panel for containing the popcorn kernels, wherein the first side panel comprises a first gusset with a first fold area comprising a first panel portion adjacent the base panel, and wherein the first gusset is expandable in the first fold area;

a second side panel between the base panel and the top panel for containing the popcorn kernels, wherein the second side panel is substantially opposite to the first side panel, wherein the second side panel comprises a second gusset with a second fold area comprising a second panel portion adjacent the base panel, and wherein the second gusset is expandable in the second fold area;

wherein the construct is comprised of a fibrous material; and a microwave susceptor film in the base panel for receiving microwaves and heating the popcorn kernels, wherein the microwave susceptor film comprises an oil-resistant film with a microwave interactive material, wherein the oil-resistant film extends across the base panel into the first fold area, and into the second fold area to resist oil penetrating through the fibrous material, wherein the microwave interactive material is present only in the base panel, and wherein the microwave susceptor film forms a tray structure with a bottom on the base panel and opposed sides along the first side panel and the second side panel.

11. The construct for heating microwave popcorn of claim 10, wherein the fibrous material comprises a laminate having an inner layer and an outer layer, and wherein the microwave susceptor film is between the inner layer and the outer layer.

12. The construct for heating microwave popcorn of claim 10, wherein the oil-resistant film comprises a biodegradable cellulose material.

13. The construct for heating microwave popcorn of claim 10, wherein the microwave interactive material has a first side substantially facing the first side panel and a second side substantially facing the second side panel, and wherein the first side is tapered toward the base panel until no microwave interactive material is present at the first side panel, and the second side is tapered toward the base panel until no microwave interactive material is present at the second side panel.

14. The construct for heating microwave popcorn of claim 10, wherein the oil-resistant film extends into the first side panel substantially the entire distance between the base panel and the top panel.

15. The construct for heating microwave popcorn of claim 14, wherein the oil-resistant film extends into the second side panel substantially the entire distance between the base panel and the top panel.

16. The construct for heating microwave popcorn of claim 10, comprising:

a first end portion and a second end portion, wherein the second end portion is spaced apart from and is opposite the first end portion;

wherein the first side panel extends along the base panel substantially the entire distance between the first end portion and the second end portion; and wherein the oil-resistant film extends along the first side panel substantially the entire distance between the first end portion and the second end portion.

17. The construct for heating microwave popcorn of claim 16, wherein the second side panel extends along the base panel substantially the entire distance between the first end portion and the second end portion; and wherein the oil-resistant film extends along the second side panel substantially the entire distance between the first end portion and the second end portion.

18. The construct for heating microwave popcorn of claim 10, wherein the first panel and the second panel each includes an area where the surface of the fibrous material has an oil-resistant substance and the microwave susceptor film is not present.

19. The construct for heating microwave popcorn of claim 1, including a fourth panel between the second panel and the third panel, wherein the fourth panel is opposite of the first panel, and wherein the microwave susceptor film extends along the first side panel and the second side panel substantially the entire distance between the first panel and the fourth panel.

20. The construct for heating microwave popcorn of claim 1, wherein the second panel includes a fold line and the third panel includes a fold line, wherein the microwave susceptor film extends across the fold line of the second panel and the fold line of third panel.

21. A construct for heating microwave popcorn, comprising:

an interior space with an interior volume;

a first panel with a surface for supporting popcorn kernels in the interior space;

a second panel adjacent to the first panel for containing the popcorn kernels in the interior space;

a third panel that is adjacent to the first panel and opposed to the second panel;

a fourth panel between the second panel and the third panel, wherein the fourth panel is opposite of the first panel;

wherein each of the second panel and the third panel has an expandable portion;

wherein the construct is comprised of a fibrous material; and a microwave susceptor film in the first panel for receiving microwaves and applying heat to the popcorn kernels, wherein the microwave susceptor film comprises an oil-resistant material, and wherein the microwave susceptor film extends across the first panel into the second panel to resist oil penetrating through the fibrous material;

wherein the microwave susceptor film extends across the first panel into the expandable portion of each of the second panel and the third panel, wherein when the expandable portion of each of the second panel and the third panel is expanded, and wherein the microwave susceptor film forms a tray structure with a bottom on the first panel and opposed sides along the second panel and the third panel.

22. The construct for heating microwave popcorn of claim 21, including a fourth panel between the second panel and the third panel, wherein the fourth panel is opposite of the first panel, and wherein the microwave susceptor film extends along the first side panel and the second side panel substantially the entire distance between the first panel and the fourth panel.

23. The construct for heating microwave popcorn of claim 21, wherein the second panel includes a fold line and the third panel includes a fold line, wherein the microwave susceptor film extends across the fold line of the second panel and the fold line of third panel.

* * * * *